US009611112B2

(12) United States Patent
Campagnolle et al.

(10) Patent No.: US 9,611,112 B2
(45) Date of Patent: Apr. 4, 2017

(54) STORAGE MODULE WITH STACKING AND UNSTACKING FUNCTIONS

(71) Applicant: SOLYSTIC, Bagneux (FR)

(72) Inventors: Pierre Campagnolle, Allex (FR); Stéphane Ambroise, Serves sur Rhone (FR); Christian Duclot, Annonay (FR); Damien Hugues, Chabeuil (FR); Mikaël Dauvergne, Mercurol (FR)

(73) Assignee: SOLYSTIC, Bagneux (FR)

( * ) Notice: Subject to any disclaimer, the term of this patent is extended or adjusted under 35 U.S.C. 154(b) by 247 days.

(21) Appl. No.: 14/386,227

(22) PCT Filed: Jul. 10, 2014

(86) PCT No.: PCT/FR2014/051779

§ 371 (c)(1),
(2) Date: Sep. 18, 2014

(87) PCT Pub. No.: WO2015/044540

PCT Pub. Date: Apr. 2, 2015

(65) Prior Publication Data

US 2016/0257510 A1 Sep. 8, 2016

(30) Foreign Application Priority Data

Sep. 30, 2013 (FR) ..... 13 59385

(51) Int. Cl.
*B65H 3/54* (2006.01)
*B07C 1/02* (2006.01)
(Continued)

(52) U.S. Cl.
CPC ..... *B65H 3/54* (2013.01); *B07C 1/025* (2013.01); *B65H 1/02* (2013.01); *B65H 1/08* (2013.01);
(Continued)

(58) Field of Classification Search
CPC .... B65H 3/045; B65H 3/0653; B65H 3/0692; B65H 3/08; B65H 3/0615; B65H 3/12;
(Continued)

(56) References Cited

U.S. PATENT DOCUMENTS 4,678,175 A * 7/1987 Arldt ..... B65H 1/08 271/154
5,417,414 A * 5/1995 Belec ..... B65H 29/52 271/178
(Continued)

FOREIGN PATENT DOCUMENTS

DE 1081832 B 5/1960
DE 1286966 B 1/1969
(Continued)

OTHER PUBLICATIONS

French Search Report dated Jun. 2, 2014 for corresponding French Patent Application No. 1359385, filed Sep. 30, 2013, 6 pages.
(Continued)

*Primary Examiner* — David H Bollinger
(74) *Attorney, Agent, or Firm* — Merchant & Gould P.C.

(57) ABSTRACT

A storage module (1) comprises a storage zone (3) for storing flat articles (2) by accumulation in a stack and on edge, a main conveyor (9) that extends transversely to the storage zone, a stacking function for transferring an article from the main conveyor to the storage zone and for stacking it at the back of the stack of articles in the storage zone, and an unstacking function for extracting an article from the stack of articles and for transferring it to the main conveyor. The unstacking function comprises an unstacking plate (7) having a perforated belt and controlled suction and disposed between the main conveyor and the storage zone, said unstacking plate having a first segment parallel to the stack of articles and a second segment that is adjacent to the first segment and that extends slantwise relative to the first
(Continued)

segment, said controlled suction being disposed in the slantwise second segment of the unstacking plate.

8 Claims, 2 Drawing Sheets

(51) Int. Cl.

| | |
|---|---|
| ***B65H 31/06*** | (2006.01) |
| ***B65H 83/02*** | (2006.01) |
| ***B65H 3/12*** | (2006.01) |
| ***B65H 3/56*** | (2006.01) |
| ***B65H 1/02*** | (2006.01) |
| ***B65H 1/08*** | (2006.01) |
| ***B65H 31/08*** | (2006.01) |

(52) U.S. Cl.
CPC ..... *B65H 3/12* (2013.01); *B65H 3/124* (2013.01); *B65H 3/565* (2013.01); *B65H 31/06* (2013.01); *B65H 31/08* (2013.01); *B65H 83/025* (2013.01); *B65H 2701/1916* (2013.01)

(58) Field of Classification Search
CPC ..... B65H 3/36; B65H 3/42; B65H 3/0858; B65H 3/14; B65H 3/54; B65H 5/00; B65H 5/021; B65H 31/06; B65H 31/08; B65H 83/00; B65H 85/00; B65H 2301/5121; B65H 2701/1916
USPC ..... 271/3.01, 3.12, 11, 12, 94, 106
See application file for complete search history.

(56) References Cited

U.S. PATENT DOCUMENTS

| | | | | |
|---|---|---|---|---|
| 5,518,121 | A * | 5/1996 | Stevens | B07C 1/00 209/1 |
| 5,981,891 | A * | 11/1999 | Yamashita | B07C 3/02 209/584 |
| 6,533,261 | B2 * | 3/2003 | Katou | B65H 1/025 271/149 |
| 7,845,484 | B2 * | 12/2010 | Zimmermann | B07C 1/025 198/347.1 |
| 2008/0006509 | A1 | 1/2008 | Zimmermann | |
| 2008/0121572 | A1 * | 5/2008 | Zimmermann | B07C 1/02 209/606 |
| 2009/0206014 | A1 | 8/2009 | Enenkel | |

FOREIGN PATENT DOCUMENTS

| | | | |
|---|---|---|---|
| DE | 102006052315 | B3 | 4/2008 |
| EP | 0992443 | A2 | 4/2000 |
| EP | 1894868 | A2 | 3/2008 |

OTHER PUBLICATIONS

International Search Report and Written Opinion from International Patent Application No. PCT/FR2014/051779, mailed Dec. 10, 2014.
International Preliminary Report on Patentability from International Patent Application No. PCT/FR2014/051779, mailed Apr. 5, 2016.
First Examination Report from New Zealand Patent Application No. 718169, mailed Aug. 26, 2016.

* cited by examiner

STORAGE MODULE WITH STACKING AND UNSTACKING FUNCTIONS

This application is a National Stage Application of PCT/FR2014/051779, filed 10 Jul. 2014, which claims benefit of Serial No. 1359385, filed 30 Sep. 2013 in France and which applications are incorporated herein by reference. To the extent appropriate, a claim of priority is made to each of the above disclosed applications.

TECHNICAL FIELD

The invention relates to a storage module comprising a storage zone for storing flat articles by accumulation in a stack and on edge, a main conveyor that extends transversely to the storage zone, a stacking function for transferring an article from the main conveyor to the storage zone and for stacking it at the back of the stack of articles in the storage zone, and an unstacking function for extracting an article from the back of the stack of articles and for transferring it to the main conveyor.

PRIOR ART

Such a storage module is already known from Patent Document US 2008/006509. That storage module is designed to constitute a sorting outlet receptacle in a postal sorting machine.

That storage module functions both as a stacker and as an unstacker. In that storage module, the order in which the mailpieces are unstacked is of the Last In, First Out (LIFO) type: the first mailpiece stored in the stack is the last mailpiece extracted from the stack.

A coupling element is provided that forms a sort of barrier at the inlet of the storage zone when the storage module is in unstacking mode, and that forms the mailpiece conveyor when the storage module in stacking mode.

That L-shaped coupling element is mounted to pivot so as to go from a position in which it acts as a barrier to another position in which it acts as a conveyor.

In that storage module, the coupling element is pivoted manually.

Another barrier is also provided that is slidably mounted and that closes off the storage zone outlet that serves for unstacking when the storage module is in stacking mode.

Such a slidably mounted barrier suffers from the drawback of increasing the risks of jamming at the outlet of the storage module due to the fact that that slidably mounted barrier can come to shear a mailpiece that is partially extracted from the stack of mailpieces while going from unstacking mode to stacking mode.

Patent Document EP 1 894 868 discloses a sheet unstacking system that uses controlled suction of the type having a suction nozzle connected to a vacuum chamber and cooperating with a perforated belt mounted on drive pulleys.

It is known that, in that type of unstacking system having controlled suction and a perforated belt, two sheets at the top of the stack may bunch together so that it is probable that the top sheet entrains the sheet below while said top sheet is being extracted from the stack of sheets.

That is why it is known to place a system beside such an unstacking system, for the purpose of preventing two or more bunched sheets from being taken together by the controlled suction.

But such anti-bunching systems are complex and costly.

In patent document EP 1 894 868, provision is made for the controlled suction to be mounted on a pivotally mounted arm so as to space the end of the sheet to be unstacked apart from the rest of the stack of sheets, thereby making it possible to reduce the risks of two or more bunched sheets being taken together.

However, such an arrangement still remains very complex and costly to implement because of the addition of moving mechanical parts.

Patent Document EP 0 992 443 discloses a sheet unstacking device that is analogous to the device known from the preceding document, but in which an unstacking plate is provided that contains the controlled suction, that unstacking plate being mounted to pivot so as to be suitable for tilting and for applying suction to the leading portion of a sheet for extracting it from the stack of sheets.

Unfortunately, such an arrangement still remains complicated to implement because of the moving parts.

With the extending capabilities for automatically processing mail in postal sorting machines, in particular for enabling the sorting outlets to be loaded and unloaded automatically, it is necessary to provide additional means to the sorting process both for the machine automation and for the machine operators, such additional means being suitable for tracking sorted stacks of mail that are extracted from the sorting outlets of the machine.

Such means are constituted by separators, which are known per se and which need to be passed through the machine with the stream of mail to be sorted so as to be inserted among stacks of sorted mail in the sorting outlets. But those separators also need to be retrieved at every sorting pass of the mail through the sorting machine so as to be recycled into the sorting process.

In order to limit the handling of such mail stack separators while the stacks of sorted mail are being recycled into the inlet of the machine, a need therefore exists for a storage module having a stacking function and an unstacking function as indicated above and that is adapted to accommodate such mail stack separators.

Such separators are in the form of flat articles analogous in size to mailpieces. They are generally made of flexible and colored cardboard sheet. Each separator is thus easy to identify visually in a sorting outlet when it is inserted between two stacks of mail.

An object of the invention is thus to propose a storage device for flat articles, and in particular for mail stack separators, which device has stacking and unstacking functions but does not suffer from the above-indicated drawbacks.

To this end, the invention provides a storage module comprising a storage zone for storing flat articles by accumulation in a stack and on edge, a main conveyor that extends transversely to the storage zone, a stacking function for transferring an article from the main conveyor to the storage zone and for stacking it at the back of the stack of articles in the storage zone, and an unstacking function for extracting an article from the back of the stack of articles and for transferring it to the main conveyor, said storage module being characterized in that the unstacking function comprises an unstacking plate having a perforated belt and controlled suction and disposed between the main conveyor and the storage zone, said unstacking plate having a first segment parallel to the stack of articles and a second segment that is adjacent to the first segment and that extends slantwise relative to the first segment, said controlled suction being disposed in the slantwise second segment of the unstacking plate.

The idea on which the invention is based is thus to have an angled unstacking plate having an inclined face in which the suction system is disposed for forcing the current flat article that is to be extracted from the stack to be deformed by folding, the effect of this deformation being to separate it better from the adjacent article in the stack of articles to be unstacked.

The leading end of said current article is thus moved by a pneumatic traction effect so as to be spaced apart from the remainder o the stack of articles at the same time as the stack of articles remains blocked by the jogging edge.

With this arrangement, it is possible to cause the storage module to go automatically from a stacking mode to an unstacking mode and vice versa, with the usual throughput rates of a postal sorting machine.

This arrangement of the unstacking system also contributes to the compactness and to the reliability of the storage module.

The storage module of the invention may have the following features:

- the second slantwise segment of the unstacking plate forms an angle lying in the range 3° to 15° relative to the top of the stack of articles;
- said first and second unstacking plate segments join each other in the vicinity of a middle longitudinal axis of the stack of articles;
- the storage zone comprises a stacking deck having rollers in contact with the underside of the stack of articles;
- the unstacking function further comprises a moving barrier suitable for being moved into a first position for preventing any article from being extracted from the stack of articles, and into a second position for allowing an article to be extracted from the stack of articles, and said moving barrier is mounted to pivot in such a manner as to push back into the storage zone any article that has been partially extracted from the stack of articles when it is pivoted to go from the second position to the first position.

BRIEF DESCRIPTION OF THE DRAWINGS

The present invention can be better understood and other advantages appear on reading the following description and on examining the accompanying drawings, in which.

DESCRIPTION OF EMBODIMENTS

Figure 1:
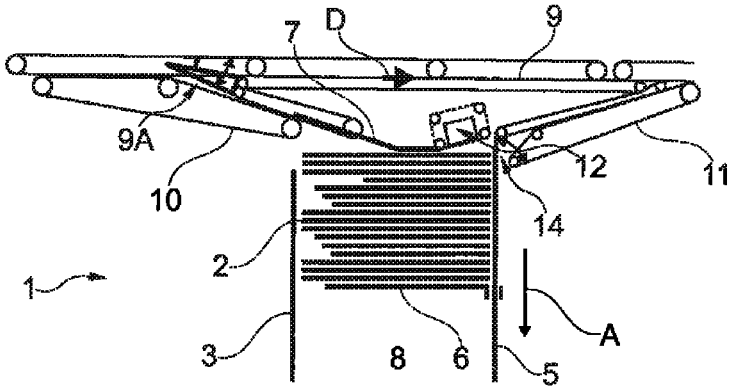
FIG. 1 is a highly diagrammatic view of a storage module of the invention in stacking mode, with mail stack separators stored in a stack on edge in the storage zone.

FIGS. 1 to 4 are highly diagrammatic views of a storage module 1 of the invention for storing flat articles, and, in this example, for storing mail stack separators 2.

Naturally, the invention is applicable to any type of flat article, such as mail or sheets of paper, or the like.

In FIGS. 1 to 4, the storage module 1 is shown diagrammatically as seen from above, the separators 2 being seen from above in a stack and on edge in the storage zone 3.

The storage zone 3 has a stacking deck or bottom that extends in a longitudinal direction A and on which the separators 2 rest on edge and extend transversely relatively to the direction A.

The storage zone has a longitudinal edge defined by a jogging edge 5 that extends along the direction A.

A paddle 6 is provided in the storage zone so as to slide along the jogging edge and retain the front of the stack of separators 2.

A return system (not shown in the figures), such as a spring, is provided for urging the paddle 6 towards a position at the back of the storage zone where an unstacking plate 7 is disposed.

The paddle 6 and its return system may be replaced with a motor-driven paddle assembly. That motor-driven assembly is servo-controlled to a sensor placed on the unstacking plate 7, making it possible to manage the pressure exerted by the stack of separators 2 on the unstacking plate 7.

That return system thus acts to oppose the movement of the paddle 6 towards the front of the storage zone as the separators accumulate into a stack, and tends to push the stack of separators 2 back towards the unstacking plate 7.

The bottom 8 may thus be mounted to move in the direction A. For example, it may comprise a notched belt mounted on idler pulleys that are disposed at the front and at the back of the storage zone.

The low end of the paddle may be engaged in a notch of the belt so that the movement of the paddle is synchronized with the movement of the belt.

The bottom 8 may also advantageously be a stacking deck having idler rollers in contact with the underside of the stack of separators, thereby limiting the friction forces exerted by the separators on the bottom 8 of the storage zone.

FIGS. 1 to 4 show a main conveyor 9 that extends in a main direction D transversely (perpendicularly in this example) to the storage zone (in direction A in this example).

In this example, the conveyor 9 is a two-belt conveyor that is suitable for moving the separators on edge and in series in the direction D by nipping them between the belts. As described below, the conveyor 9 may be constituted by the sorting conveyor in a postal sorting machine.

As shown in FIGS. 1 to 4, the unstacking plate 7 is disposed between the main conveyor 9 and the storage zone 3.

A secondary conveyor 10 is provided upstream from the storage zone relative to the direction D so as to perform a stacking function of the storage module, and another secondary conveyor 11 is provided downstream from the storage zone relative to the direction D for performing an unstacking function of the storage module.

A switching flap 9A is provided in the path of the main conveyor at the intersection with the conveyor 10 upstream from the storage zone relative to the direction D in order to divert the separators 2 moving in series and on edge from the main conveyor to the secondary conveyor 10 and in order to feed the storage zone 3 when the storage zone is in the stacking function.

The unstacking plate 7 is provided with a system 12 having a perforated belt and having controlled suction that makes it possible to extract a separator from the back of the stack of separators and to transfer it towards the main conveyor through the secondary conveyor 11.

Figure 3:
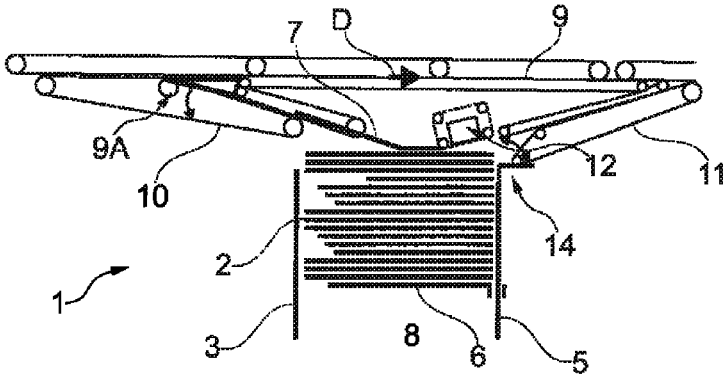
FIG. 3 is a highly diagrammatic view of a storage module of the invention in unstacking mode, with mail stack separators stored in a stack on edge in the storage zone.
Figure 4:
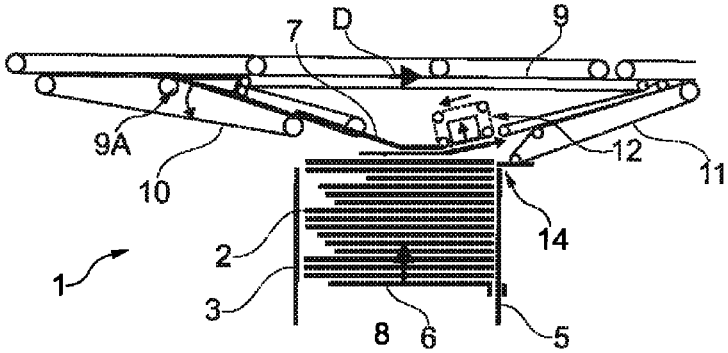
FIG. 4 is a highly diagrammatic view of the storage module in unstacking mode, with a separator being extracted from the stack of separators.
Figure 5:
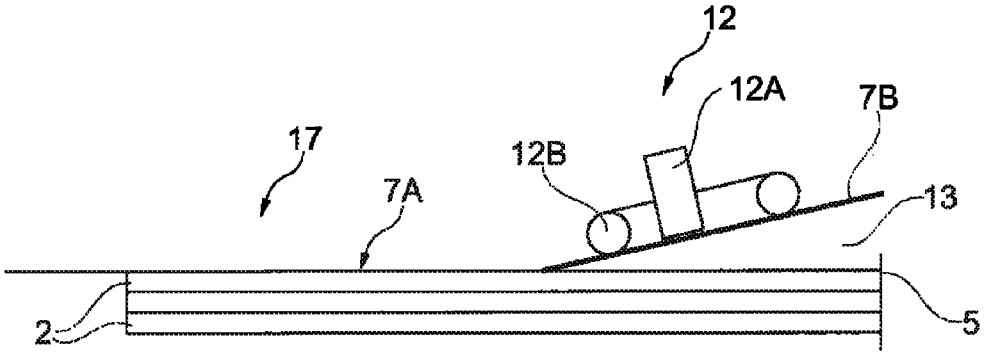
FIG. 5 shows the unstacking function in more detail with an unstacking plate of the invention having a slantwise segment and when the controlled suction is not activated.
Figure 6:
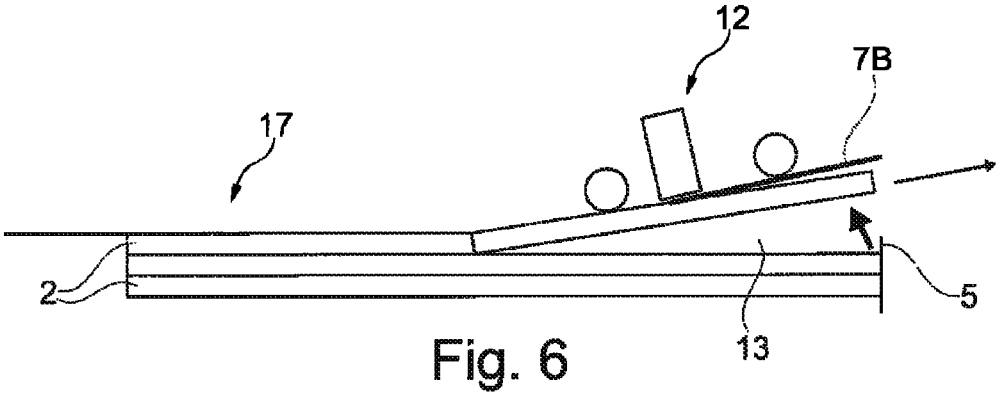
FIG. 6 shows the unstacking function with the controlled suction activated in the slantwise segment of the unstacking plate.

In accordance with the invention, the unstacking plate 7 has a first segment 7A that is shown in more detail in FIGS. 5 and 6 and that is parallel to the stack of separators 2 in the storage zone and thus to the direction D in FIGS. 1 to 4, and a second segment 7B adjacent to the segment 7A and that extends slantwise relative to the segment 7A and away from the stack of separators.

As can also be seen in FIGS. 5 and 6, the controlled suction represented by 12A (a suction nozzle connected to a vacuum chamber) is disposed in the second segment 7B of the unstacking plate, which segment is the further downstream relative to the direction D.

The perforated belt 12B is also shown, which belt forms a closed loop and is engaged over two drive pulleys, and co-operates with the controlled suction to cause the last separator stored at the back of the stack of separators to be extracted by suction and to be transferred towards the secondary conveyor 11.

In particular, in FIG. 5, the controlled suction 12A is off, and the current separator 2 to be extracted from the back of the stack of separators extends undeformed and parallel to the other separators in the stack.

The space between said current separator 2 and the segment 7B of the unstacking plate forms a sort of separation dihedral 13 that opens out towards the secondary conveyor 11 that is closed off in part by the jogging edge 5 of the storage zone.

In practice, the gap between the slantwise segment 7B and the jogging edge 5 must be greater than the thickness of a separator, e.g. in the range 3 to 4 times greater.

In FIG. 6, the controlled suction 12A is actuated, thereby causing the leading portion of the current separator 2 to be sucked against the segment 7B of the unstacking plate while the trailing portion of the current separator is pressed against the segment 7A of the unstacking plate.

The current separator 2 is thus folded substantially in its middle (middle in the transverse direction of the stack) and the leading portion of the current separator 2 is thus offset from the remainder of the stack of separators.

At the same time, the perforated belt 12B imparts movement to the current separator 2 so as to separate it from the stack and so as to transfer it towards the secondary conveyor 11 through the separation dihedral 13.

It should be noted that the separator adjacent to the current separator 2 in the stack remains in abutment against the jogging edge 5 while the current separator 2 is being extracted, thereby making it possible to avoid the risks of two or more bunched separators being taken together from the storage module in unstacking mode.

The angle of inclination of the second segment 7B of the unstacking plate relative to its segment 7A that is parallel to the stack of separators may lie in the range 3° to 15°. This angle must be compatible with the flexibility of the separators.

Preferably, the two segments 7A and 7B join each other in the vicinity of a longitudinal middle axis of the stack of articles so that each separator is deformed substantially in its middle by the unstacking plate without being damaged.

FIGS. 1 to 4 show a barrier 14 in the in the separation dihedral 13.

Figure 2:
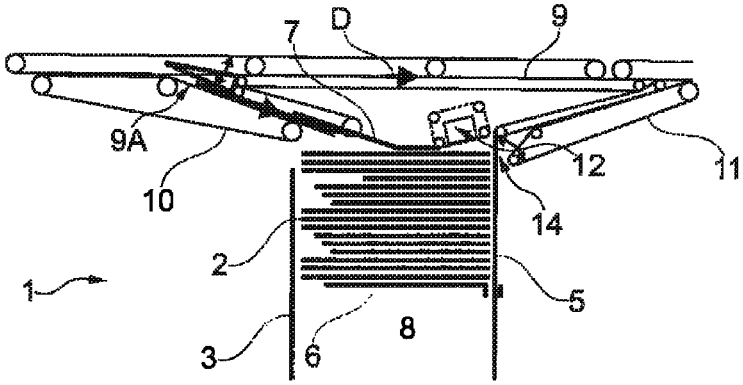
FIG. 2 is a highly diagrammatic view of the storage module in stacking mode with a separator arriving at the inlet of the storage zone.

This barrier 14 is mounted to move so as to take up a first position that is shown in FIGS. 1 and 2, in which position it prevents a separator from being extracted from the stack of separators when the storage module is in stacking mode.

In FIGS. 3 and 4, the barrier 14 has been moved to take up a second position in which it allows a separator to be extracted from the stack of separators when the storage module is in unstacking mode.

Advantageously, in accordance with the invention, the barrier 14 is a pivotally mounted barrier (as indicated by a circularly arcuate arrow in FIGS. 3 and 4) that is mounted to pivot about an axis adjacent to the end of the jogging edge 5 in the separation dihedral. With this arrangement, the pivotally mounted barrier is suitable for acting on any separator 2 that has been partially extracted from the stack due to bunching to push it back into the storage zone. Any such separator is pushed back in when the barrier 14 goes from the second position to the first position, i.e. when the storage module goes from unstacking mode to stacking mode.

This arrangement makes it possible to further reduce the risks of bunching or of jamming, and therefore increases the reliability of the storage module of the invention.

It should be noted that said pivotally mounted barrier 14 makes it possible, on its own, to reduce the risks of bunching or of jamming in a storage module having an unstacking plate 7 without a slantwise segment 7B.

Operation of the storage module with the stacking and unstacking functions is described briefly below with reference to FIGS. 1 to 4.

In FIG. 1, separators 2 are already stored in a stack and on edge in the unstacking zone 3.

The switching flap 9A is directed to divert a flow of articles from the main conveyor 9 to the secondary conveyor 10.

In stacking mode, the controlled suction 12 is off and the barrier 14 is in the first position in which it closes off the separation dihedral 13.

In FIG. 2, a separator has reached the secondary conveyor 10 and is going to be stacked at the back of the stack of separators in the storage zone 3.

As the separators 2 are moved in series and on edge along the main conveyor 9, they are thus diverted one-by-one by the flap 9A towards the secondary conveyor 10 so as to stack up one behind the other in the storage zone 3.

In FIG. 3, the storage module 1 is in unstacking mode.

The flap 9A has been actuated into a position indicated by an arrow such that the main conveyor 9 bypasses the storage module 1. The flap 9A thus closes off the passageway from the conveyor 9 to the conveyor 10.

In addition, the barrier 14 is in the second position in which it opens up the separation dihedral 13.

In FIG. 4, when the controlled suction 12 is activated, the leading portion of the current separator 2 at the back of the stack in the storage zone is sucked against the slantwise segment 7B of the unstacking plate, and said current separator is then extracted and transferred towards the main conveyor 9 via the separation dihedral 13 and via the secondary conveyor 11.

Figure 7:
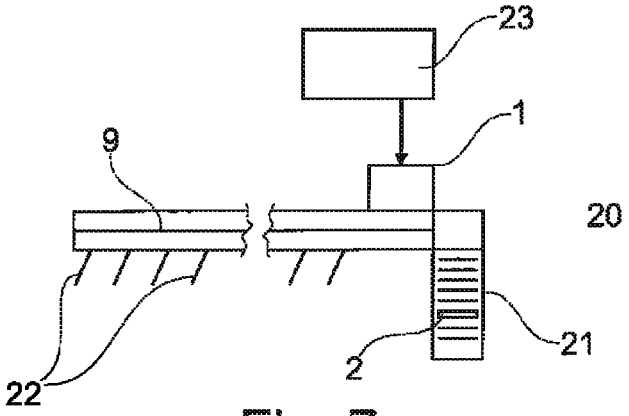
FIG. 7 is a highly diagrammatic view of an example of a postal sorting machine for sorting mail, which machine includes a storage module for mail stack separators.

FIG. 7 shows a postal sorting machine 20 by way of example, with a mailpiece unstacker 21 that puts the mailpieces into series in the sorting machine.

In the feed magazine of the unstacker 21, two stacks of mailpieces are shown that are separated by a separator 2, e.g. of the flexible cardboard type.

In this example, the sorting machine has sorting outlets 22 and a storage module of the invention for separators 1, which storage module is disposed between the sorting outlets 22 and the unstacker 21, along the sorting conveyor of the machine that, in this example, constitutes the main conveyor 9 of the storage module 1.

FIG. 7 shows a monitoring and control unit that controls the actuators of the sorting machine, and, in particular, the actuators of the flap 9A, of the controlled suction 12, and of the barrier 14 in the storage module.

In a postal sorting machine with a sorting conveyor having a return loop that loops back towards an inlet for feeding mailpieces into the machine, the storage module 1 for mail stack separators may be disposed upstream from said return loop, e.g. after the sorting outlets.

The invention claimed is:

1. A storage module comprising a storage zone for storing flat articles by accumulation in a stack and on edge, a main conveyor that extends transversely to the storage zone, a secondary conveyor for transferring an article from the main conveyor to the storage zone and for stacking the article at the back of the stack of articles in the storage zone, and an unstacking plate for extracting an article from the back of the stack of articles and for transferring the article to the main conveyor, wherein the unstacking plate comprises a perforated belt and controlled suction, said unstacking plate being disposed between the main conveyor and the storage zone, said unstacking plate having a first segment parallel to the stack of articles and a second segment that is adjacent to the first segment and that extends slantwise relative to the first segment, said controlled suction being disposed in the slantwise second segment of the unstacking plate.

2. A storage module according to claim 1, wherein the second slantwise segment of the unstacking plate forms an angle lying in the range 3° to 15° relative to the top of the stack of articles.

3. A storage module according to claim 1, wherein said first and second unstacking plate segments join each other in the vicinity of a middle longitudinal axis of the stack of articles.

4. A storage module according to claim 1, wherein the unstacking plate comprises a moving barrier suitable for being moved into a first position for preventing any article from being extracted from the stack of articles, and into a second position for allowing an article to be extracted from the stack of articles, and wherein said moving barrier is pivotally mounted to push back into the storage zone any article that has been partially extracted from the stack of articles when the barrier is pivoted to go from the second position to the first position.

5. A postal sorting machine comprising a storage module according to claim 1.

6. A postal sorting machine according to claim 5, wherein the storage module is adapted to store mail stack separators in a stack and on edge.

7. A postal sorting machine according to claim 6, comprising a sorting conveyor extending along sorting outlets of the machine, said sorting conveyor constituting the main conveyor of the storage module.

8. A postal sorting machine according to claim 6, wherein the separators are made of flexible cardboard.

* * * * *